US010583344B2

(12) United States Patent
Hilton et al.

(10) Patent No.: US 10,583,344 B2
(45) Date of Patent: Mar. 10, 2020

(54) PUTTER WITH ALIGNMENT AID

(71) Applicant: Callaway Golf Company, Carlsbad, CA (US)

(72) Inventors: Thomas R. Hilton, Cardiff, CA (US); Sean Toulon, Vista, CA (US); Augustin W. Rollinson, Solana Beach, CA (US); Patrick Dawson, San Diego, CA (US); Bradley C. Rice, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 16/377,725

(22) Filed: Apr. 8, 2019

(65) Prior Publication Data

US 2019/0240557 A1 Aug. 8, 2019

Related U.S. Application Data

(62) Division of application No. 15/876,640, filed on Jan. 22, 2018, now Pat. No. 10,293,237.

(60) Provisional application No. 62/547,016, filed on Aug. 17, 2017.

(51) Int. Cl.

| | |
|---|---|
| ***A63B 53/04*** | (2015.01) |
| ***A63B 69/36*** | (2006.01) |
| ***A63B 1/00*** | (2006.01) |
| *A63B 53/00* | (2015.01) |

(52) U.S. Cl.
CPC ..... *A63B 69/3685* (2013.01); *A63B 1/00* (2013.01); *A63B 53/0487* (2013.01); *A63B 53/007* (2013.01); *A63B 2053/0441* (2013.01)

(58) Field of Classification Search
CPC ..... A63B 2053/0437; A63B 2053/0441
USPC ..... 473/340, 342, 350
See application file for complete search history.

(56) References Cited

U.S. PATENT DOCUMENTS

| | | | | |
|---|---|---|---|---|
| 7,438,648 | B2 * | 10/2008 | Wahl | A63B 53/0487 473/340 |
| 7,491,131 | B2 * | 2/2009 | Vinton | A63B 53/0487 473/251 |
| 9,144,717 | B2 * | 9/2015 | Franklin | A63B 53/007 |

* cited by examiner

*Primary Examiner* — Raeann Gorden
(74) *Attorney, Agent, or Firm* — Rebecca Hanovice; Michael Catania; Sonia Lari

(57) ABSTRACT

A putter head comprising a novel alignment structure is disclosed herein. In particular, the putter comprises an alignment sphere attached to an upper surface of a lower flange and an alignment ring suspended over the lower flange and vertically aligned with the alignment sphere. When a golfer has oriented the putter properly in front of a golf ball at address, the alignment sphere will appear to the golfer to be encircled by the alignment ring.

20 Claims, 7 Drawing Sheets

PUTTER WITH ALIGNMENT AID

CROSS REFERENCES TO RELATED APPLICATIONS

The present application is a divisional of U.S. patent application Ser. No. 15/876,640, filed on Jan. 22, 2018, which claims priority to U.S. Provisional Application No. 62/547,016, filed on Aug. 17, 2017, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head, particularly a putter, with an alignment aid. In particular, the alignment aid comprises an upper opening and a removable insert that aligns with the upper opening when the golfer is aligned with the club at address.

Description of the Related Art

The prior art discloses different types of alignment features incorporated into golf club heads, and on putters in particular. There still is a need, however, for an improved putter alignment system that also allows a golfer to change the specific alignment aid.

BRIEF SUMMARY OF THE INVENTION

One aspect of the present invention is a putter with an alignment aid that appears to be contained within an alignment ring or structure when a golfer's head is properly oriented with respect to the putter head at address with a golf ball.

Another aspect of the present invention is a putter head comprising a body portion comprising a striking face, a rear surface opposite the striking face, an upper portion, a lower portion, a heel side, a toe side, and an aft edge spaced from the striking face, the lower portion having an upper surface and a lower surface, a support bar extending from the body portion towards the aft edge, the support bar comprising a first end, a midsection, and a second end, an alignment ring connected to the support bar, an alignment structure extending vertically from the upper surface of the lower portion, the alignment structure vertically aligned with the alignment ring along a vertical Z axis, wherein the alignment structure does not make direct contact with the support bar or the alignment ring, and wherein the alignment ring is spaced from, and does not make direct contact with, any portion of the body portion.

In some embodiments, each of the first end and the second end may be affixed to the body portion, and the midsection may be suspended over the lower portion. In a further embodiment, the putter head may comprise a stem extending from the midsection of the support bar towards the body portion and connecting to the alignment ring so that the alignment ring is suspended over the lower portion, and the stem may space the alignment ring from the support bar. In another embodiment, the alignment structure may be removably affixed to the upper surface. In a further embodiment, the putter head may comprise a bolt, the lower portion may comprise a threaded through-bore extending from the lower surface to the upper surface, the alignment structure may comprise a threaded receiving bore, and a portion of the bolt may extend through the threaded through-bore to engage the threaded receiving bore.

In some embodiments, the alignment structure may be a sphere. In a further embodiment, the sphere may comprise a first color, the alignment ring may comprises a second color, and the first color may contrast with the second color. In a further embodiment, the support bar may comprises a third color, which may contrast with the first color and the second color. In an alternative embodiment, the rear surface of the striking face may comprise a fourth color, which may contrast with the first color. In yet another alternative embodiment, the upper surface may comprise a fifth color, which may contrast with the first color. In still other embodiments, the alignment structure may be a cylinder comprising at least one fiber optic filament, which may be coiled within the cylinder.

In another embodiment, the upper portion of the body may comprise an alignment line extending perpendicular to the striking face and aligned with the alignment ring along a horizontal x-axis extending perpendicular to the striking face in a front-to-back direction. In yet another embodiment, the putter head may further comprise a face insert, and the striking face may comprise a recess sized to receive the face insert. In yet another embodiment, the lower portion may comprise at least one unthreaded through-hole, and the support bar may extend over the at least one unthreaded through-hole.

Yet another aspect of the present invention is a putter head comprising a body portion comprising a striking face, a rear surface opposite the striking face, an upper portion, a lower portion, a heel side, a toe side, and an aft edge spaced from the striking face, the lower portion having an upper surface and a lower surface, first and second support bars extending from the body portion towards the aft edge, the first support bar extending approximately parallel with the second support bar, an alignment ring suspended between the first and second support bars, and a sphere affixed to the upper surface of the lower portion and vertically aligned with the alignment ring along a vertical Z axis, wherein the sphere does not make direct contact with the first support bar, the second support bar, or the alignment ring, and wherein the alignment ring is spaced from, and does not make direct contact with, any portion of the body portion. In some embodiments, the sphere may be removably affixed to the upper surface. In a further embodiment, the putter head may comprise a bolt, the lower portion may comprise a threaded through-bore extending from the lower surface to the upper surface, the sphere may comprise a threaded receiving bore, and a portion of the bolt may extend through the threaded through-bore to engage the threaded receiving bore.

In some embodiments, the lower portion may comprise a heel-side portion having a first front-to-back length, a middle portion having a second front-to-back length, and a toe-side portion having a third front-to-back length, and the second front-to-back length may be less than the first and third front-to-back lengths. In a further embodiment, the first front-to-back length may be approximately equivalent to the third front-to-back length.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
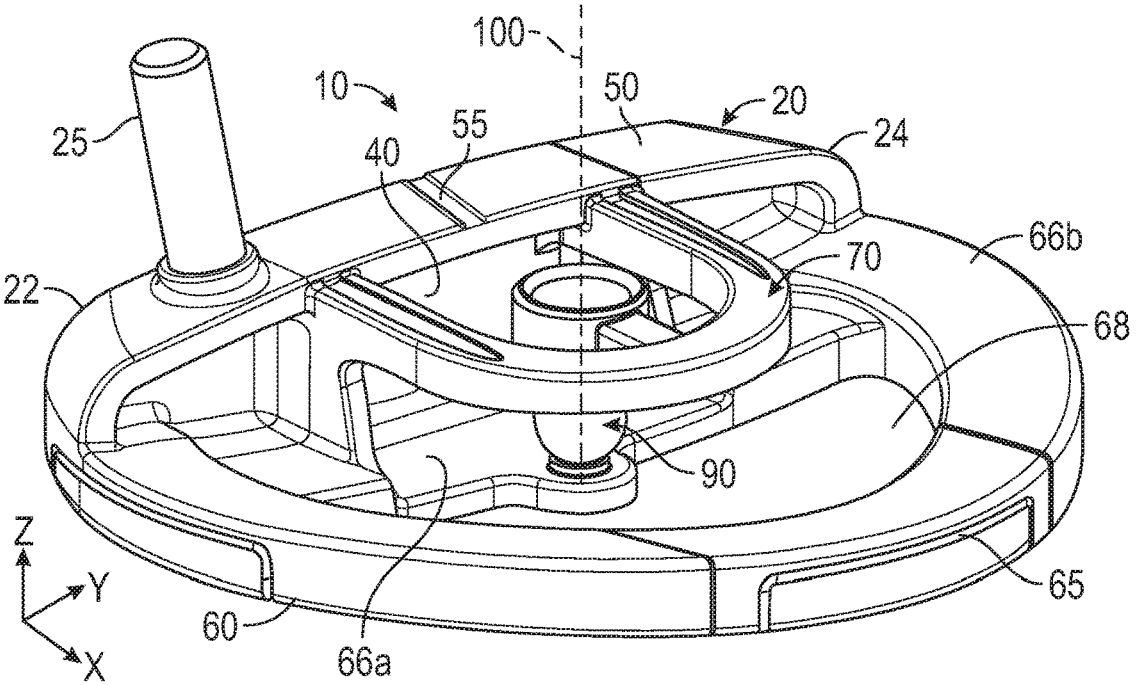
FIG. 1 is a rear perspective view of a first embodiment of the putter head of the present invention.
Figure 2:
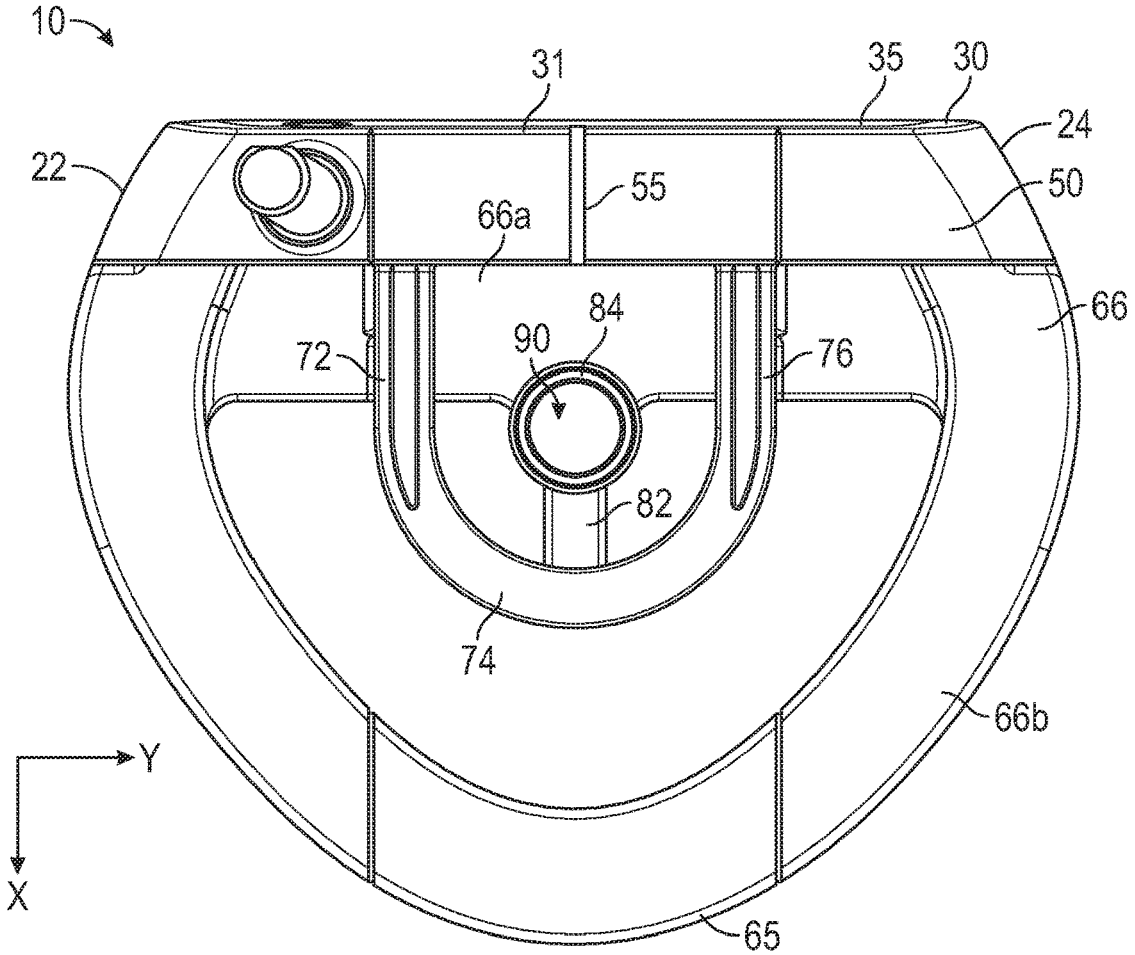
FIG. 2 is a top plan view of the embodiment shown in FIG. 1.
Figure 3:
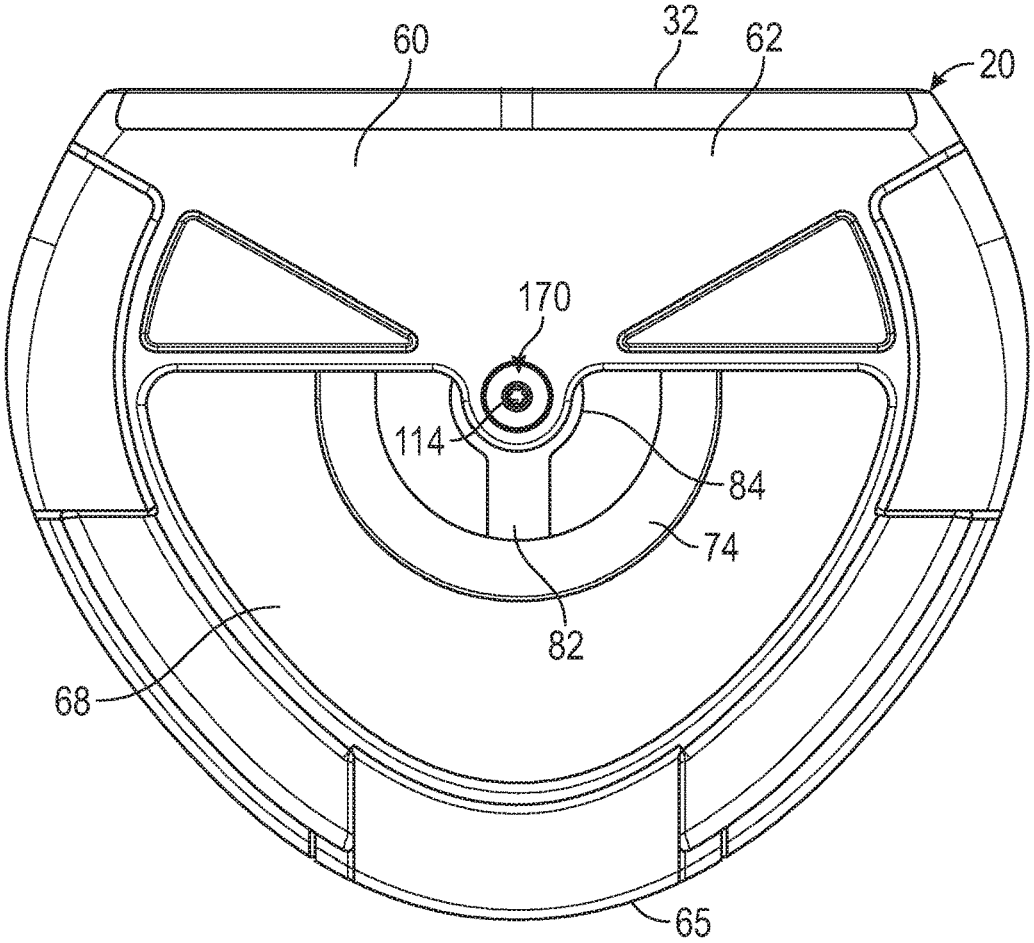
FIG. 3 is a bottom plan view of the embodiment shown in FIG. 1.
Figure 4:
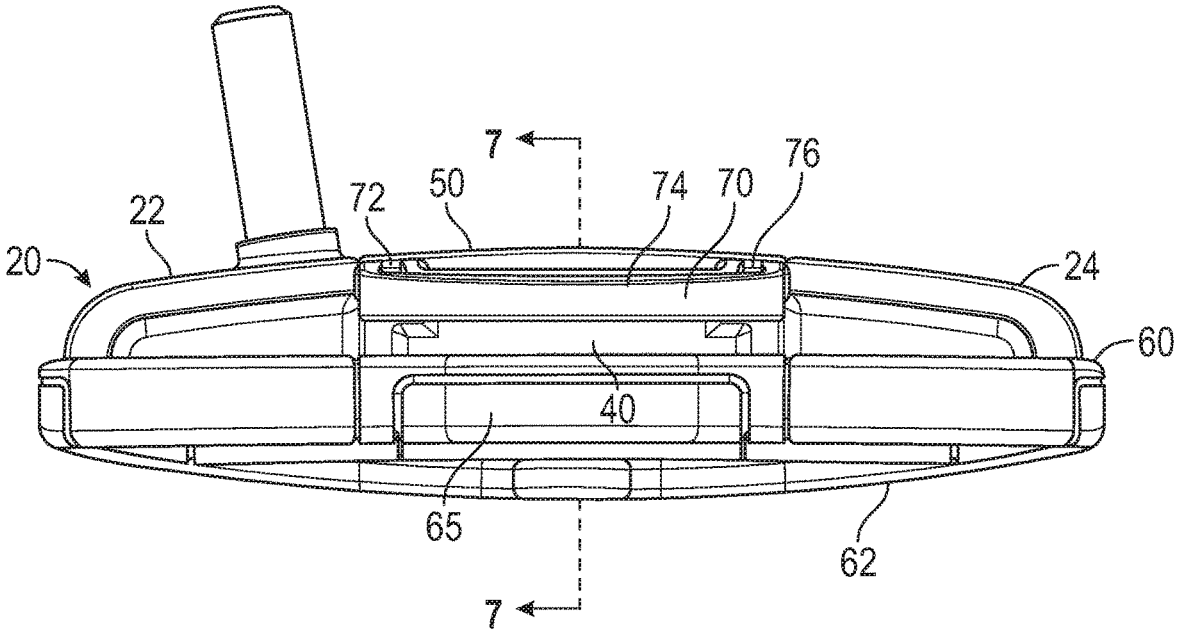
FIG. 4 is a rear elevational view of the embodiment shown in FIG. 1.
Figure 5:
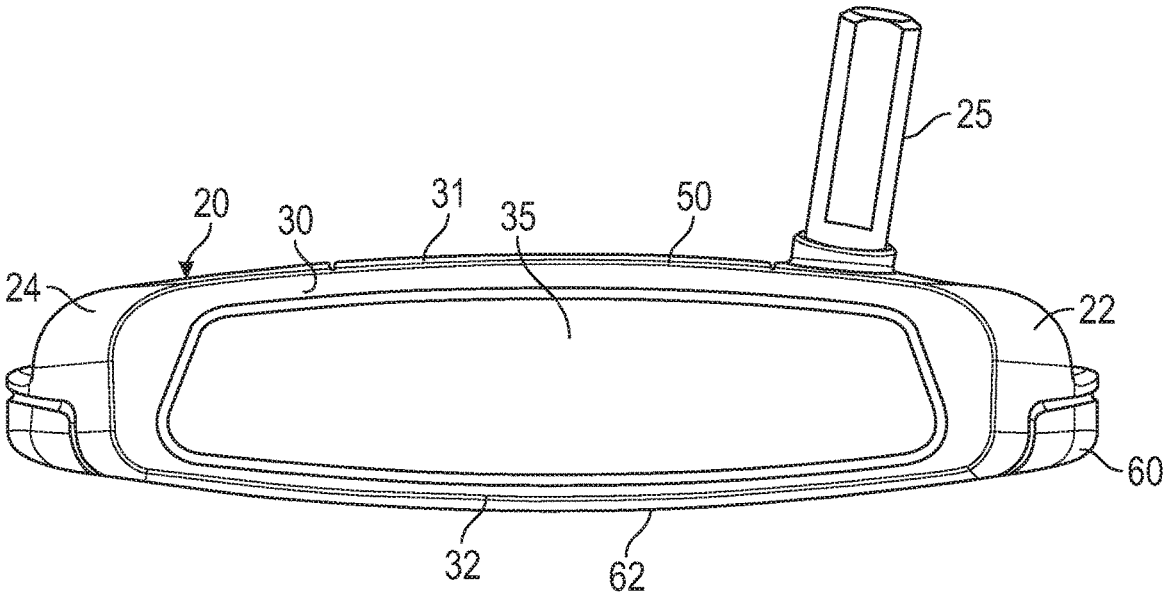
FIG. 5 is a front elevational view of the embodiment shown in FIG. 1.
Figure 6:
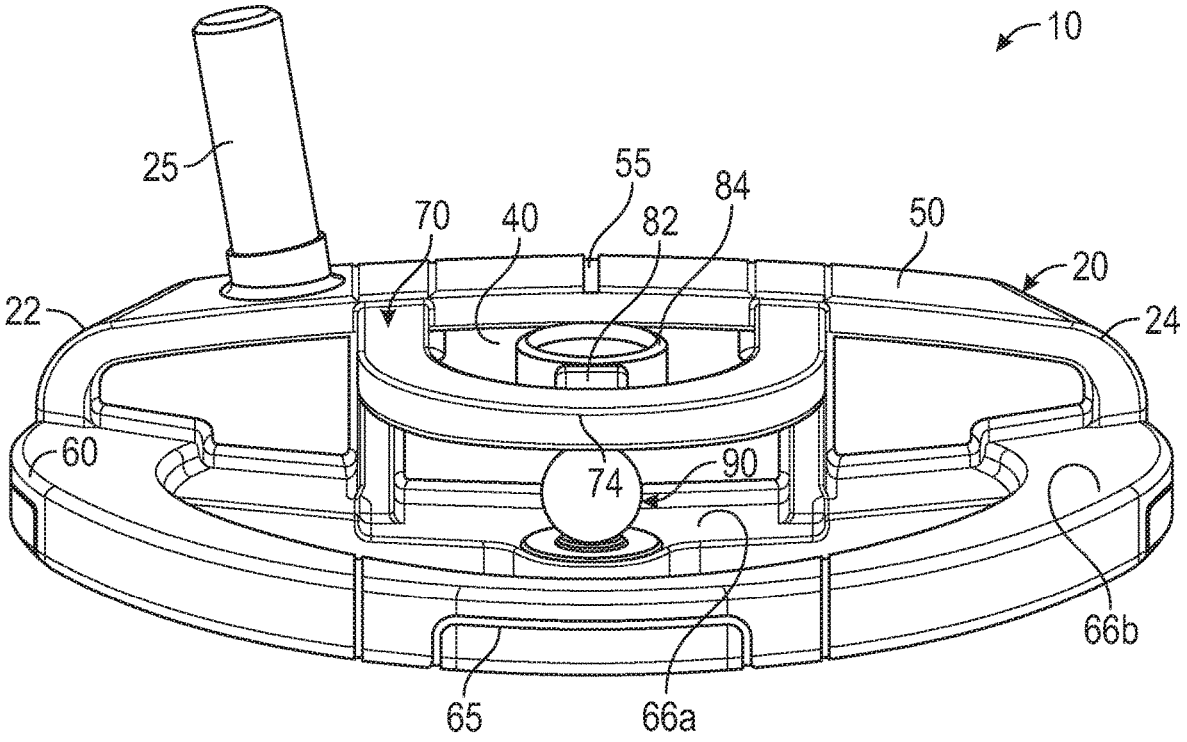
FIG. 6 is another rear perspective view of the putter head shown in FIG. 1.
Figure 7:
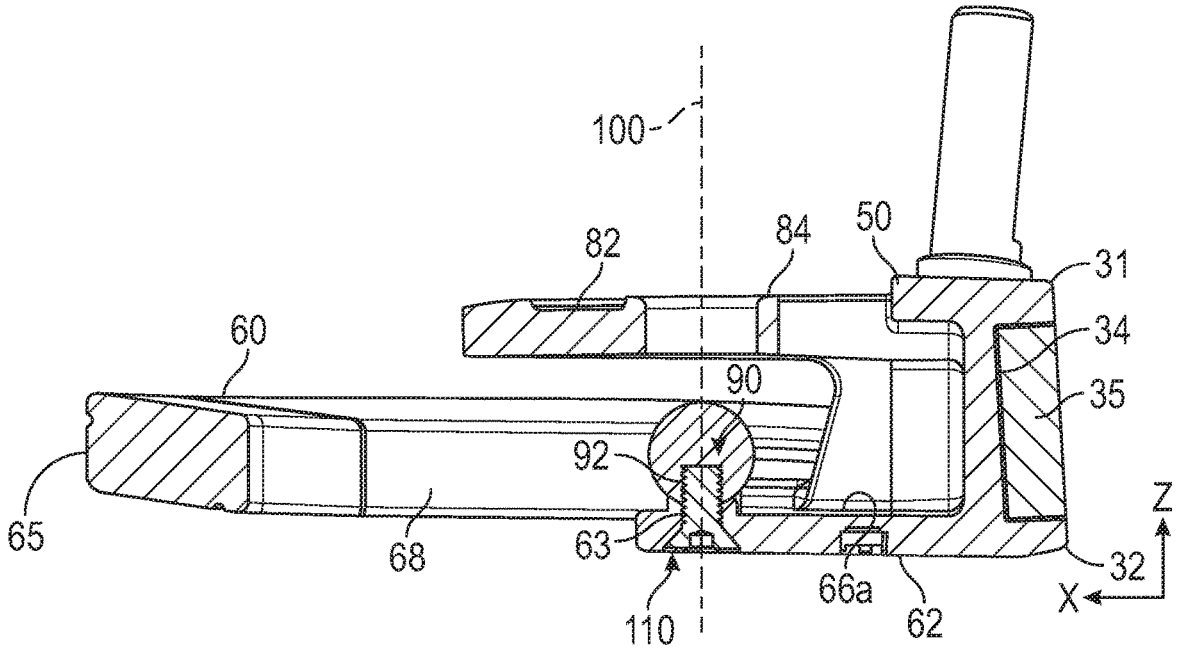
FIG. 7 is a cross-sectional view of the embodiment shown in FIG. 4 along lines 7-7.
Figure 8:
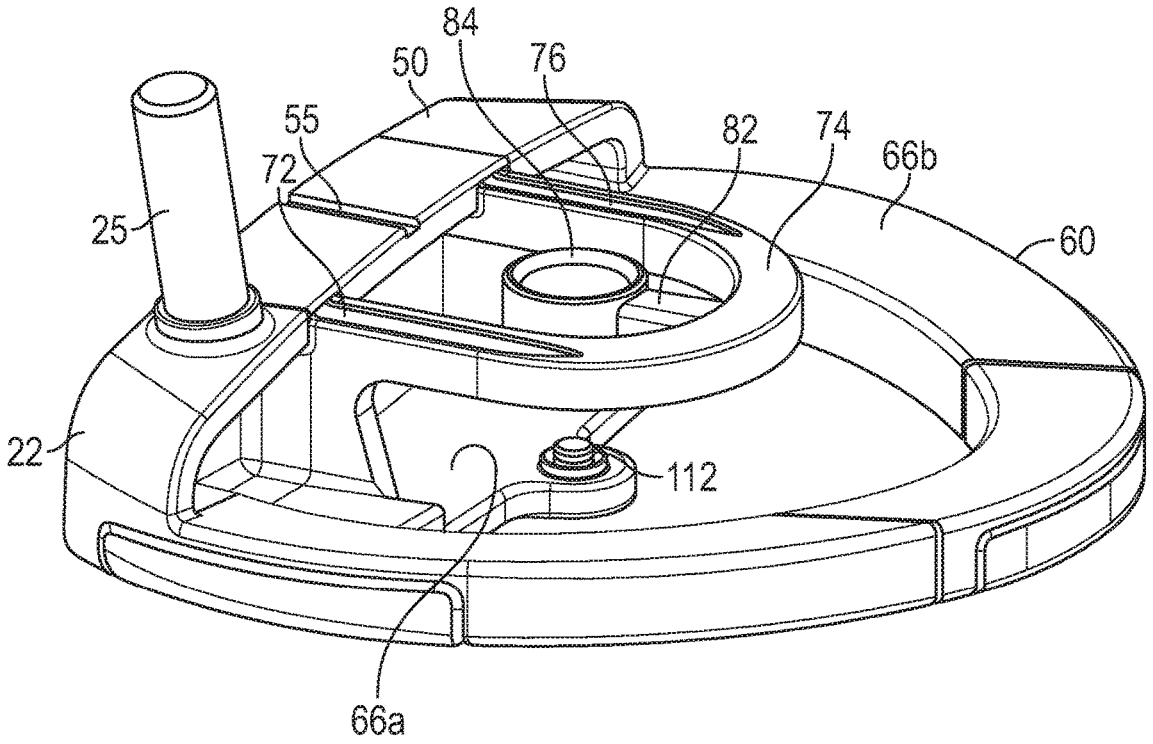
FIG. 8 is a rear perspective view of the embodiment shown in FIG. 1 without the alignment sphere.
Figure 9:
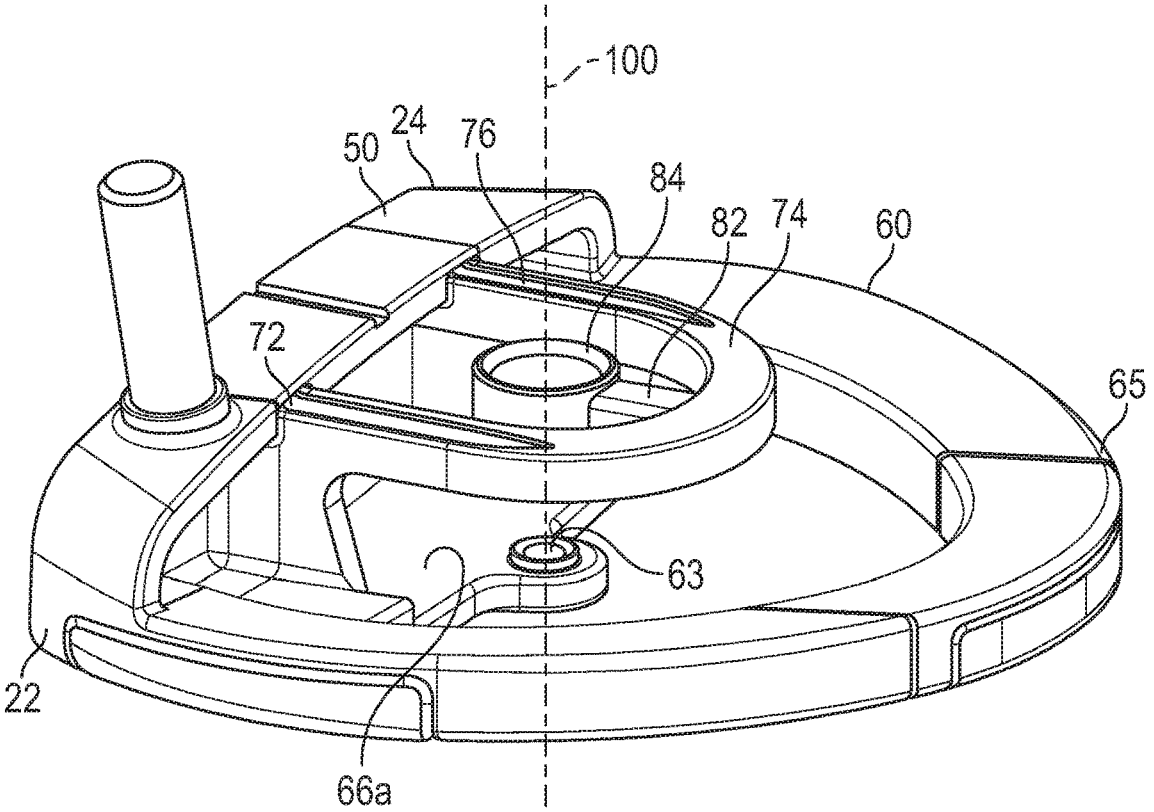
FIG. 9 is a rear perspective view of the embodiment shown in FIG. 1 without the alignment sphere or the bolt.
Figure 10:
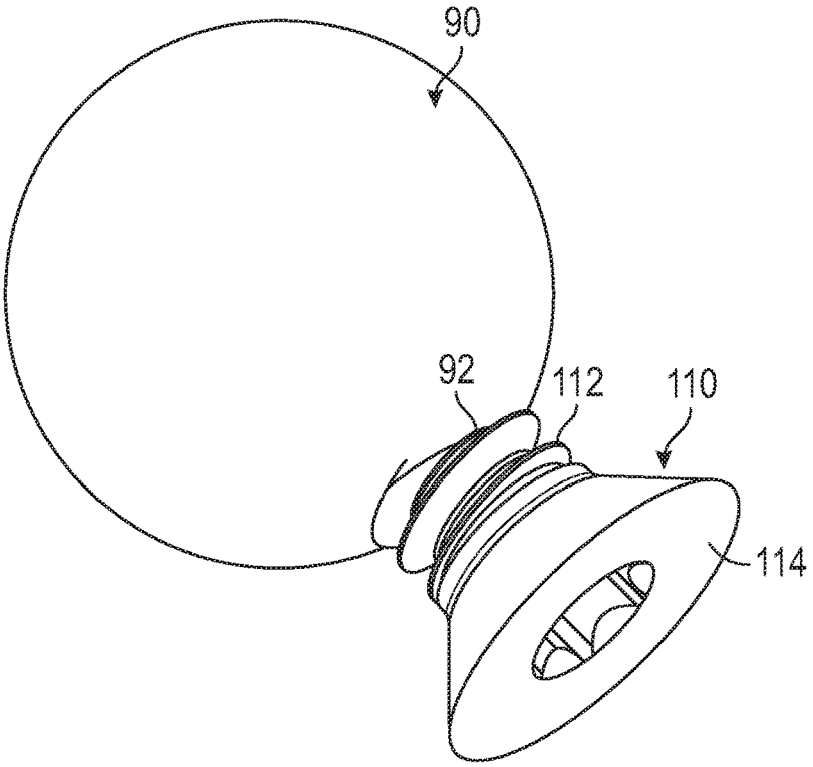
FIG. 10 is a side perspective view of the alignment sphere engaged with the bolt.

The present invention is directed to a golf club head, and particularly a putter head, with a removable alignment structure and an alignment ring or sighting structure disposed vertically above the alignment structure. Before striking a golf ball, a golfer can confirm that the putter is properly oriented by aligning his or her head over the putter head so that the alignment structure appears to be entirely bounded within the alignment ring or sight structure.

A preferred embodiment of the putter head 10 of the present invention is shown in FIGS. 1-10. The putter head 10 comprises a body portion 20 having a heel side 22 proximate a hosel 25, a toe side 24, a striking face 30 with a recess 34 sized to receive a face insert 35, a rear surface 40 opposite to, and extending approximately parallel with, the striking face 30, an upper portion 50 extending approximately perpendicular to the striking face 30 from an upper edge 31 of the striking face 30, and a lower portion 60 or flange extending approximately perpendicular to the striking face 30 from a lower edge 32 of the striking face 30 and comprising an aft edge 65, a lower surface 62, and an upper surface 66. The upper surface 66 has a first region **66*a* disposed directly behind the rear surface 40 and a second region 66*b* encircling the first region 66*a*, and the lower portion 60 has at least one through-opening or hole 68 proximate the aft edge 65. The upper portion 50 of the body 20 preferably includes an alignment line 55 that extends perpendicular to the striking face 30 along a horizontal x-axis, and is approximately centered between the heel side 22 and the toe side 24 along a horizontal y-axis extending parallel with the striking face 30**.

The putter head 10 also includes a U-shaped support bar 70 having a first end 72 affixed to the body 20 towards the heel side 22, a midsection 74, and a second end 76 affixed to the body 20 towards the toe side 24. The support bar 70, which preferably is integrally formed with the body 20 but may be formed separately and then permanently affixed to the body 20, extends from the body 20 over the lower portion 60 toward the aft edge 65 so that the midsection 74 is suspended over the hole 68, though in alternative embodiments the lower portion 60 may lack the hole 68 entirely and the support bar 70 may be suspended completely over the upper surface 66 of the lower portion 60. A stem 82 extends from the midsection 75 towards the body 20 and supports an alignment ring 84 that is suspended vertically over the first upper surface region **66*a*. No portion of the alignment ring 84, which is spaced from the support bar 70 by the stem 82 and is centered between the heel and toe sides 22, 24 of the body along the horizontal y-axis, directly contacts the body 20 or the support bar 70**.

The lower portion 60 of the body 20 also includes a threaded through-bore 63 that extends from the lower surface 62 through the first upper surface region **66*a* and is vertically aligned with the alignment ring 84 along a vertical z-axis 100. The threaded portion 112 of a bolt 110 extends through the threaded through-bore 63 and engages the threaded bore 92 of an alignment sphere 90 to removably affix the alignment sphere 90 to the first upper surface region 66*a* of the lower portion 60. When the threaded portion 112 is fully engaged with the threaded through-bore 63 and the alignment sphere 90, the head 114 of the bolt abuts the lower surface 62 of the lower portion 60. When the alignment sphere 90 is secured to the lower portion 60 via the bolt 110, it is vertically aligned with the alignment ring 84 along the vertical z-axis 100 and appears to be encircled by the alignment ring 84 when a golfer has properly aligned her head over the putter head 10** at address before striking a golf ball.

Figure 11:
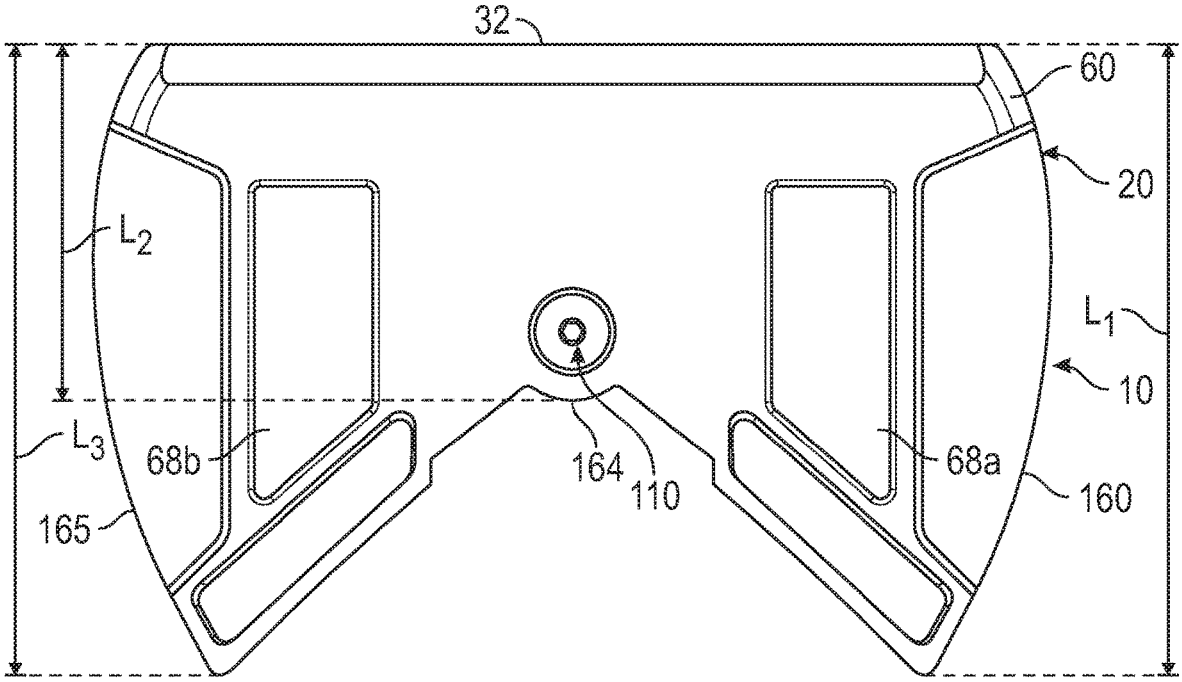
FIG. 11 is a bottom plan view of a second embodiment of the putter head of the present invention.
Figure 12:
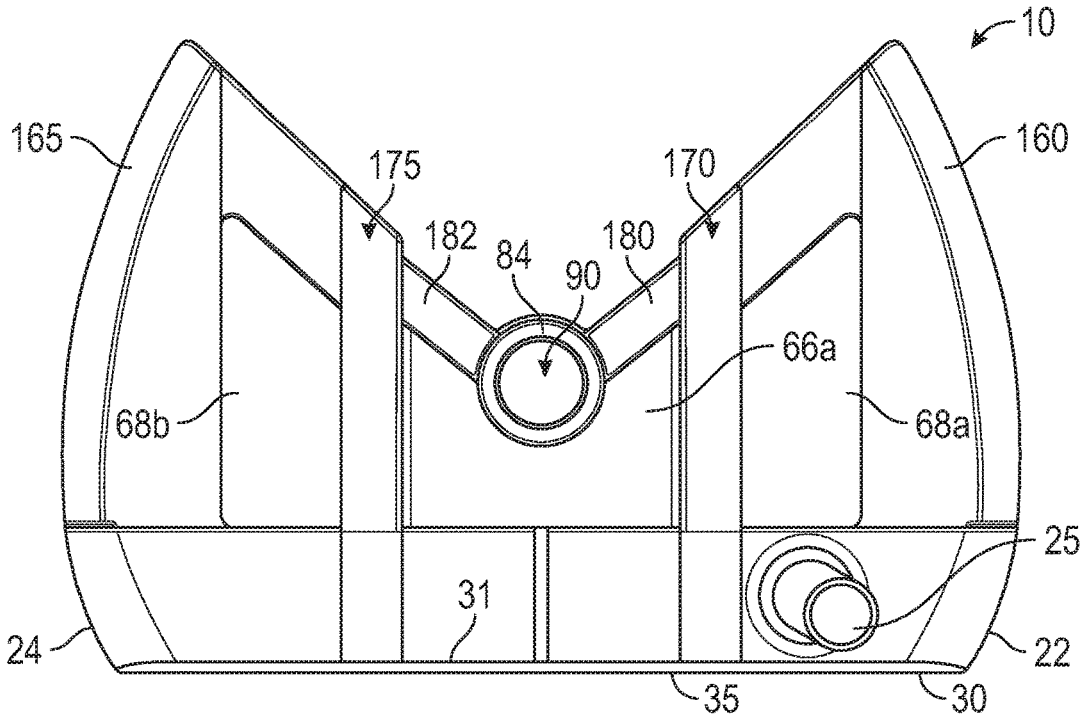
FIG. 12 is a top plan view of the embodiment shown in FIG. 11.
Figure 13:
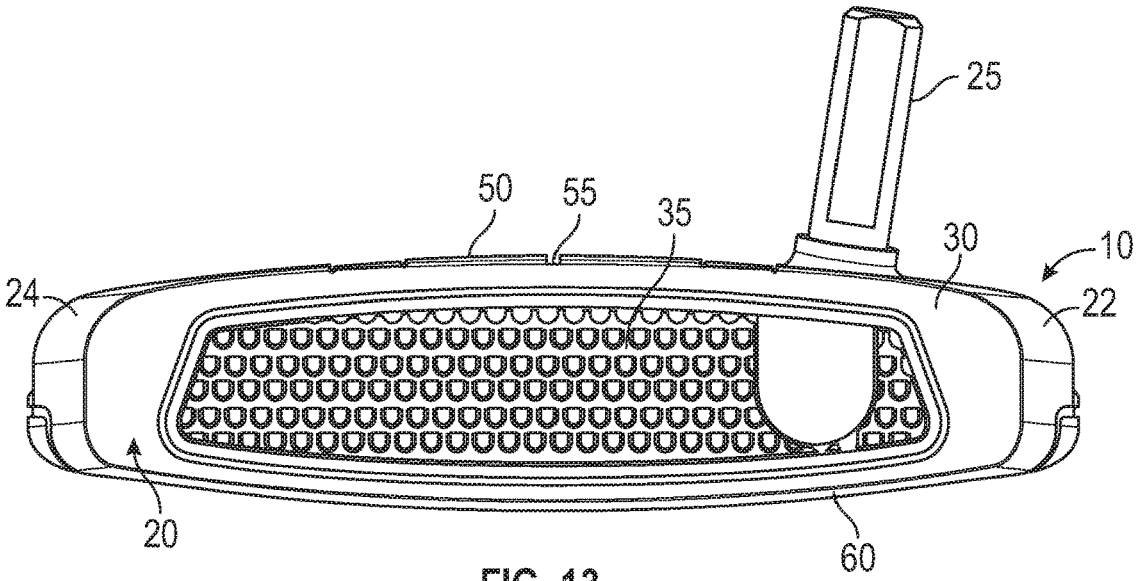
FIG. 13 is a front elevational view of the embodiment shown in FIG. 11.
Figure 14:
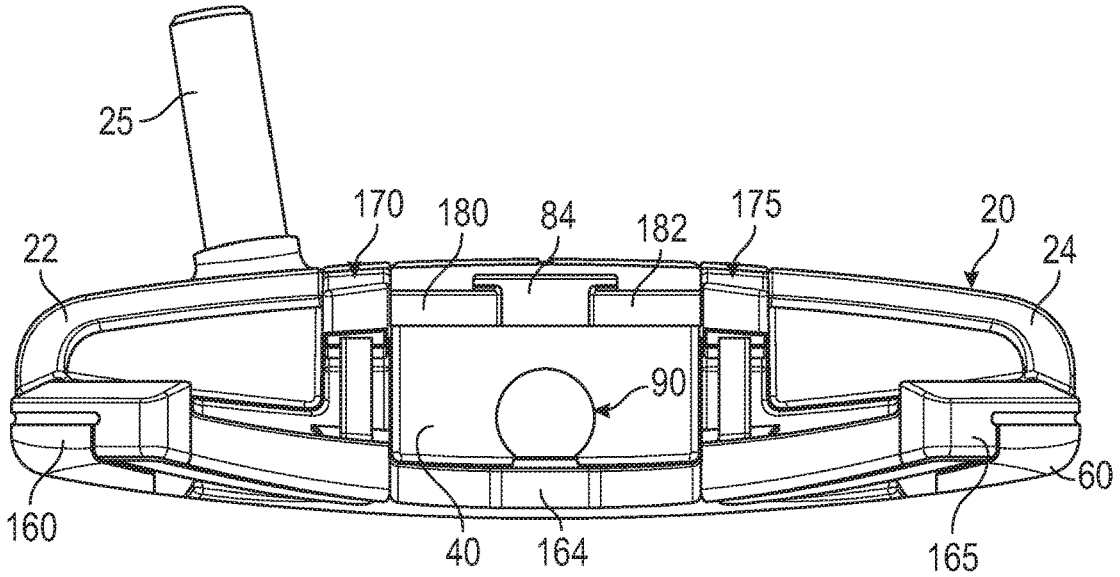
FIG. 14 is a rear elevational view of the embodiment shown in FIG. 11.
Figure 15:
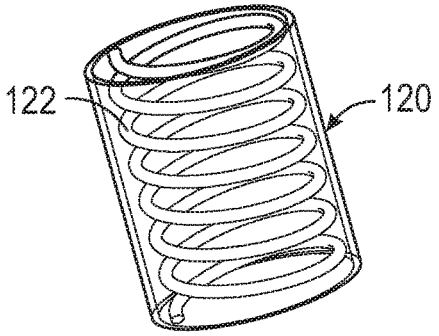
FIG. 15 is a side perspective view of an alignment cylinder.

Another embodiment of the present invention is shown in FIGS. 11-14. In this embodiment, the putter head 10 has many of the same features as the preferred embodiment, except that instead of a single, U-shaped support bar 70, first and second support bars 170, 175 extend away from the body 20 approximately parallel to one another and perpendicular to the rear surface 40 along the horizontal x-axis, and a pair of stems 180, 182 extend from the rearmost ends 171, 176 of the support bars at less than a 90° angle with respect to the support bars 170, 175 to connect the support bars 170, 175 to the alignment ring 84. Like in the preferred embodiment, the alignment ring 84 is suspended over the first upper surface region **66*a* of the lower portion 60, but in this embodiment, the entirety of each support bar 170, 175 is also suspended over the lower portion 60 instead over through-holes 68*a*, 68*b*, which in this embodiment are disposed at heel and toe sides 160, 165 of the lower portion 60. The lower portion 60 of the body 20 in this second embodiment has a heel side 160 with a first length $L_1$, a middle portion 164 with a second length $L_2$, and a toe side 165 with a third length $L_3$. As shown in FIGS. 11 and 12**, the first and third lengths $L_1$, $L_3$ are preferably approximately equivalent to one another and are greater than the second length $L_2$.

In each of the embodiments disclosed herein, the alignment sphere 90 has a first color that contrasts with other parts of the putter head 10, and particularly the alignment ring 84, so as to maximize its visibility to a golfer. The first color also preferably contrasts with the color of the rear surface 40 of the body 20, the upper surface 66 of the lower portion 60, and with the support bars 70, 170, 175. In particular, the alignment sphere 90 preferably is red, the support bars 70, 170, 175 are white, the alignment ring 84 and upper surface 66 is black or dark gray, and the rear surface 40 is dark or light gray.

In an alternative embodiment, the alignment sphere 90 may be replaced with a cylinder 120 that includes one or more coiled fiber optic filaments 122 that can catch the light and make the cylinder 120 appear to glow when the putter head 10 is in use. The fiber optic filaments 122 preferably have the same color green as that of a putting green to assist with alignment. The cylinder 120 includes a threaded bore 92 at one end so that it can be removably affixed to the upper surface 66 of the lower portion 60.

The body 20 of the putter head 10 preferably is composed of a high strength material, such as titanium alloy or stainless steel, while the alignment sphere 90 is formed of a lighter weight material such as aluminum ally, carbon composite, or plastic to reduce the overall weight of the putter head 10 and ensure a low center of gravity. The material composition of the different parts of the putter head 10 can, however, be adjusted as desired by the golfer to change the center of gravity location.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A putter head comprising:

a body portion comprising a striking face, a rear surface opposite the striking face, an upper portion, a lower portion having an upper surface and a lower surface, a heel side, and a toe side;

first and second support bars extending away from the body portion;

an alignment ring suspended between the first and second support bars by at least one stem; and an alignment structure affixed to the upper surface of the lower portion and vertically aligned with the alignment ring along a vertical Z axis, wherein the alignment structure does not make direct contact with the first support bar, the second support bar, or the alignment ring, and wherein the alignment ring is spaced from, and does not make direct contact with, any portion of the body portion.

2. The putter head of claim 1, wherein the alignment structure is removably affixed to the upper surface of the lower portion.

3. The putter head of claim 2, further comprising a bolt, wherein the lower portion comprises a threaded through-bore extending from the lower surface to the upper surface, wherein the alignment structure comprises a threaded receiving bore, and wherein a portion of the bolt extends through the threaded through-bore to engage the threaded receiving bore.

4. The putter head of claim 1, wherein the lower portion comprises a heel-side portion having a first front-to-back length, a middle portion having a second front-to-back length, and a toe-side portion having a third front-to-back length, wherein the second front-to-back length is less than the first and third front-to-back lengths.

5. The putter head of claim 4, wherein the first front-to-back length is approximately equivalent to the third front-to-back length.

6. The putter head of claim 1, wherein the alignment structure is a sphere.

7. The putter head of claim 6, wherein the sphere comprises a first color, wherein the alignment ring comprises a second color, and wherein the first color contrasts with the second color.

8. The putter head of claim 7, wherein each of the first and second support bar comprises a third color, wherein the third color contrasts with the first color and the second color.

9. The putter head of claim 7, wherein the rear surface of the striking face comprises a fourth color, and wherein the fourth color contrasts with the first color.

10. The putter head of claim 7, wherein the upper surface comprises a fifth color, and wherein the fifth color contrasts with the first color.

11. The putter head of claim 1, wherein the first support bar extends approximately parallel with the second support bar.

12. The putter head of claim 1, wherein the alignment structure is a cylinder comprising at least one fiber optic filament.

13. The putter head of claim 12, wherein the at least one fiber optic filament is coiled within the cylinder.

14. The putter head of claim 1, wherein the upper portion comprises an alignment line extending perpendicular to the striking face, and wherein the alignment line is aligned with the alignment ring along a horizontal x-axis extending perpendicular to the striking face in a front-to-back direction.

15. The putter head of claim 1, further comprising a face insert, wherein the striking face comprises a recess sized to receive the face insert.

16. The putter head of claim 1, wherein the body is composed of a material selected from a group consisting of titanium alloy and stainless steel, and wherein the alignment structure is formed of a material selected from a group consisting of aluminum ally, carbon composite, and plastic.

17. The putter head of claim 1, wherein the at least one stem comprises first and second stems.

18. The putter head of claim 17, wherein the first stem extends from the first support bar, wherein the second stem extends from the second support bar, and wherein at least one of the first and second stem extends at an angle of less than 90° with respect to the support bar to which it is connected.

19. A putter head comprising:

a body portion comprising a striking face, a rear surface opposite the striking face, an upper portion, a lower portion having an upper surface and a lower surface, a heel side, a toe side, and a recess in the striking face;

first and second support bars extending away from the body portion;

a face insert;

an alignment ring;

a first stem extending from a rearmost end of the first support bar to the alignment ring;

a second stem extending from a rearmost end of the second support bar to the alignment ring; and an alignment sphere removably affixed to the upper surface of the lower portion and vertically aligned with the alignment ring along a vertical Z axis, wherein the face insert is disposed within the recess in the striking face, wherein the first and second support bars extend approximately perpendicular to the body portion and parallel with one another, wherein the alignment sphere does not make direct contact with the first support bar, the second support bar, or the alignment ring, and wherein the alignment ring is spaced from, and does not make direct contact with, any portion of the body portion.

20. The putter head of claim 19, wherein each of the first and second stem extends at an angle of less than 90° with respect to the support bar to which it is connected.

* * * * *